United States Patent [19]

Ferguson et al.

[11] 4,403,770

[45] Sep. 13, 1983

[54] APPARATUS FOR COLLATING SIGNATURES

[76] Inventors: Leonard Ferguson, 7206 W. Walden Pl., Littleton, Colo. 80123; Jack W. Mefford, 395 Iris St., Broomfield, Colo. 80020

[21] Appl. No.: 360,190

[22] Filed: Mar. 22, 1982

[51] Int. Cl.[3] ..... B65H 5/30

[52] U.S. Cl. ..... 270/55; 270/57; 271/103

[58] Field of Search ..... 270/54–58; 271/103, 108

[56] References Cited

U.S. PATENT DOCUMENTS

| | | | |
|---|---|---|---|
| 1,043,401 | 11/1912 | Cox . | |
| 2,709,584 | 5/1955 | Kleinberg | 270/53 |
| 2,817,513 | 12/1957 | Bell et al. | 270/54 |
| 2,901,249 | 8/1959 | Dexter | 270/58 |
| 3,048,388 | 8/1962 | Smith | 270/57 |
| 3,069,025 | 12/1962 | Winkler et al. | 214/1 |
| 3,127,163 | 3/1964 | Chambers | 270/57 |
| 3,372,924 | 3/1968 | Treff | 271/29 |
| 3,547,429 | 12/1970 | Hepp | 270/54 |
| 3,572,683 | 3/1971 | Hepp | 270/54 |

*Primary Examiner*—A. J. Heinz

*Attorney, Agent, or Firm*—John E. Reilly

[57] ABSTRACT

A signature collating machine having a plurality of sequentially situated signature supply stations whose common floor rises via an electronic sensor to maintain signature stacks at operable heights. Above each supply station is a suction delivery assembly, each of said assemblies having a suction port housing and a suction port extending therefrom for engagement with a signature. The machine further has traveling collector rods which sequentially gather signatures engaged with respective suction ports. An actuator is provided which causes upward movement of a suction delivery assembly, and consequent positioning of a signature for subsequent collating, upon suction port engagement with a signature. Circuitry is provided which causes collector rod travel to cease if any suction port ahead of a collector rod is not engaged with a signature, thus eliminating accidental non-inclusion of a signature. Upon collector rod engagement and lateral pressure within the fold of a signature, suction delivery to the suction port automatically discontinues and the signature is released therefrom to be then maintained on the collector rod. A similar manually-operable collating machine is also disclosed.

12 Claims, 11 Drawing Figures

APPARATUS FOR COLLATING SIGNATURES

This invention relates to a novel and improved signature collating method and apparatus, and more particularly relates to collating apparatus having automatic activation and deactivation means.

BACKGROUND AND FIELD OF THE INVENTION

In the assembly of magazines, newspapers, booklets, and the like, collating machines are broadly used to gather, in sequential order, the several pages comprising the particular publication. The pages so gathered generally are printed as "signatures", with each signature being a single sheet of paper folded once along its midline to create two leaves. These signatures are then gathered in sequential order within each other along respective fold lines to yield a folded stack of paper, such as, a magazine which can be stitched if desired along the fold line.

As is appreciated by both the collator operator and the ultimate reader of a publication so assembled, it is imperative that no signature be missed during the collating process. Assuming each signature is printed on both sides of both leaves thereof, the absence of only one such signature obviously results in the absence of four pages from a publication so assembled. Thus, only a singular miss of a signature by a collating apparatus can result in an unreadable, and necessarily discarded, publication.

It is therefore apparent that a need is present for a collating machine which possesses fail-safe provisions in regard to non-inclusion of a signature, and which is highly reliable and efficient requiring a minimum number of steps in operation.

Representative of this approach are disclosed in U.S. Pat. Nos. 1,043,401 to S. C. Cox; 2,709,584 to J. Kleinberg; and 2,817,513 to D. T. Bell et al. Of these patents, Cox is of interest for disclosing a method and apparatus wherein the signatures are opened by a vacuum and a pusher rod is advanced between successive signatures for assembling into a magazine, book or the like. Kleinberg discloses a similar type of pivotal valve operation and vacuum system. Bell's device is provided with pivotal suction of vacuum heads for disposing signatures in the path of a collector arm, the pivotal movement of the arm actuating a valve to relieve the vacuum when the signature has been collected. Other patents of general interest in the field are U.S. Pat. Nos. 3,069,025 to R. Winkler et al; 3,372,924 to E. H. Treff; and 3,547,429 and 3,572,683 to R. Hepp. Winkler et al discloses a specific type of rotary valve arrangement to control the application of vacuum in forming blanks into envelopes wherein the valve is adapted to control application of vacuum during selected period of time in the course of revolution of the valve. The Treff patent illustrates yet another type of valve arrangement wherein the vacuum is periodically relieved at timed intervals in response to movement of a sheet past a vacuum port. The Hepp patents are further illustrations of utilization of suction in spreading signatures for collating systems wherein spreading rollers are employed for collecting the signatures.

SUMMARY OF THE INVENTION

The subject of the instant invention is a collating machine capable of sequentially engaging a plurality of folded signatures comprising two leaves and gathering said signatures sequentially within each other along the respective folds of said signatures for subsequent stitching or binding. In the collating apparatus of the present invention, there is provided a plurality of juxtaposed signature stations for supporting stacks of folded signatures, vacuum producing means, a suction delivery assembly above the signature station and which assembly comprises a suction port housing having a pivotal suction port in communication with said vacuum producing means, the suction port being engagable with the top leaf of a top signature disposed within each respective signature station, and actuator means operative to cause upward movement of the suction delivery assembly only upon application of a vacuum to the suction port when the suction port is in engagement with a signature. A further characteristic of the suction port housing is that it is capable of deactivating the vacuum producing means when the housing suction port is pivoted. In this way, when a travelling collector rod is sequentially advanced between the leaves of the successive top signatures which are engaged and lifted by the respective suction ports, the rod will in the process of removing each top signature away from the suction port cause pivoting of the suction port and deactivation of the vacuum producing means. In one embodiment of the present invention, the suction delivery assembly is manually operable to advance each of the suction port housings into engagement with the top signatures and to lift same into position for removal by a collector rod which is manually advanced along a predetermined path. In another embodiment of the present invention, the suction delivery assembly is automatically advanced into a position bringing the suction port housings into engagement with the top signatures, which are then movable upwardly into the path of advancement of a mechanized, traveling collector rod which successively advances into engagement with the fold of each signature whereby to collect a series of signatures in interleaved relation and to deposit same at the end of the last signature station.

More specifically, in the automated collating apparatus of the present invention, there is provided a plurality of sequentially situated supply stations for housing signatures, with the floor of said supply stations vertically height adjustable via sensor means in response to the height of a stack of signatures thereon, and with each of said supply stations further having means for separation of the leaves of the top signature of a stack housed therein; vacuum producing means; a suction delivery assembly situated above each supply station, said assembly comprising a suction port housing, a portion of which is arcuately pivotal, having protruding from said pivotal portion a suction port in communication with the vacuum producing means, said suction port engageable, via suction delivered thereto, with the top leaf of the top signature housed within the supply station, the assembly further having actuator means to cause upward movement of said assembly only upon suction port engagement with a signature, and the suction port housing having vacuum deactivation means actuated when the pivotal portion of said housing is arcuately pivoted; and at least one traveling collector rod, said rod having actuator means to cause sequential placement of said rod between the leaves of the sequential signatures as said signatures are engaged with respective suction ports, said rod collecting each such signature thereon as it travels, with said rod having deactivation means actuated by absence of a signature engaged with a suction port.

The machine as recited above automatically gathers the several signatures for subsequent binding as desired. Dividers separating adjacent supply stations, as well as the suction delivery assemblies recited above, can be movable laterally to facilitate accommodation of variously dimensioned signatures. It is preferred that the several actuator and sensor means be activated through utilization of electronic circuitry as will be hereinafter recognizable to the skilled artisan.

Again, manual gathering of the signatures can be accomplished by elimination of the traveling collector rods from the machine and employing instead a hard-holdable collector rod which an operator can move from station to station. To further facilitate a manual operation, the electronic sensor circuitry of the suction delivery assemblies can be eliminated, and said assemblies can be operated manually to engage respective signatures for subsequent collection.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
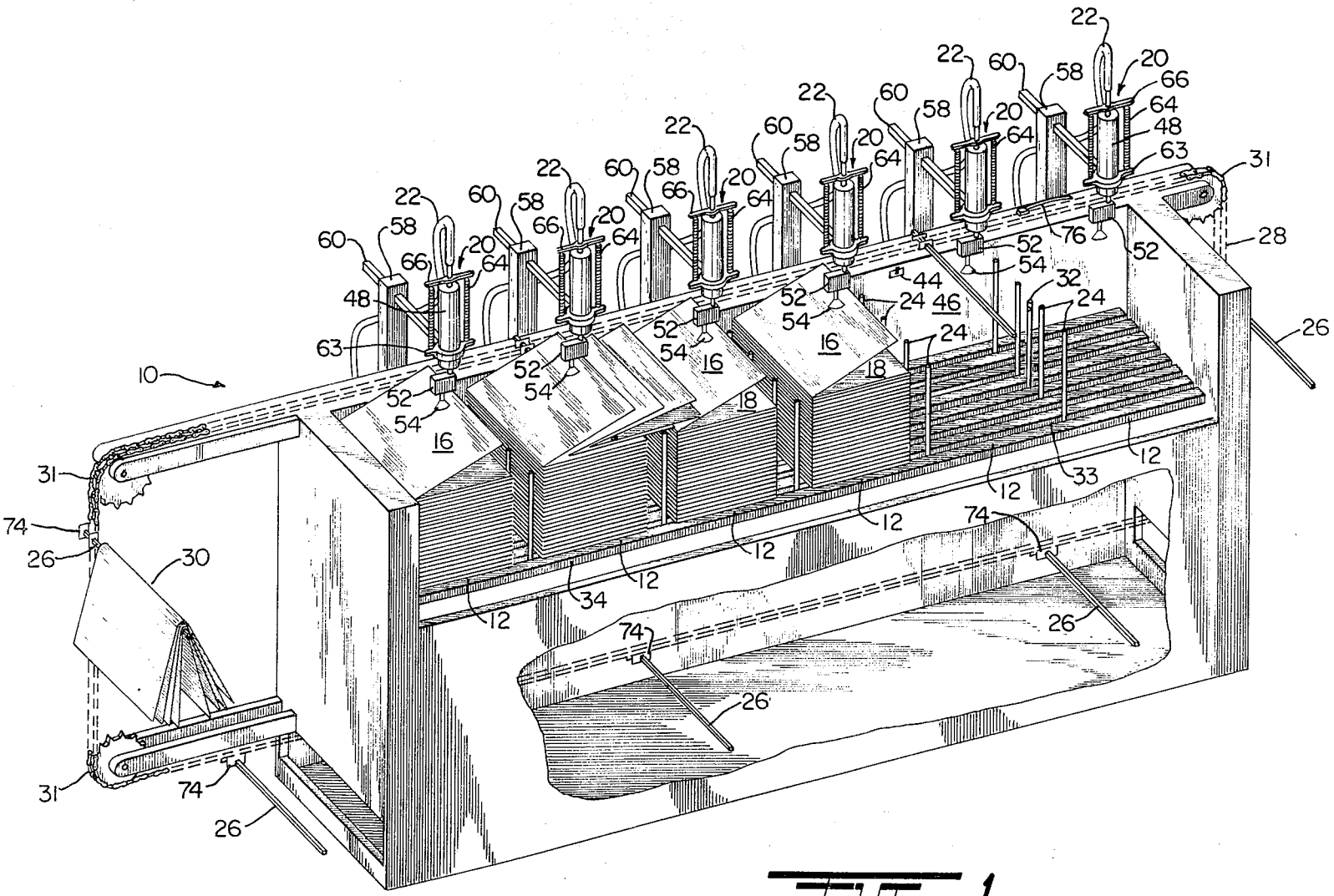
FIG. 1 is a perspective view, partially cut away, of a preferred form of signature collating machine.
Figure 2:
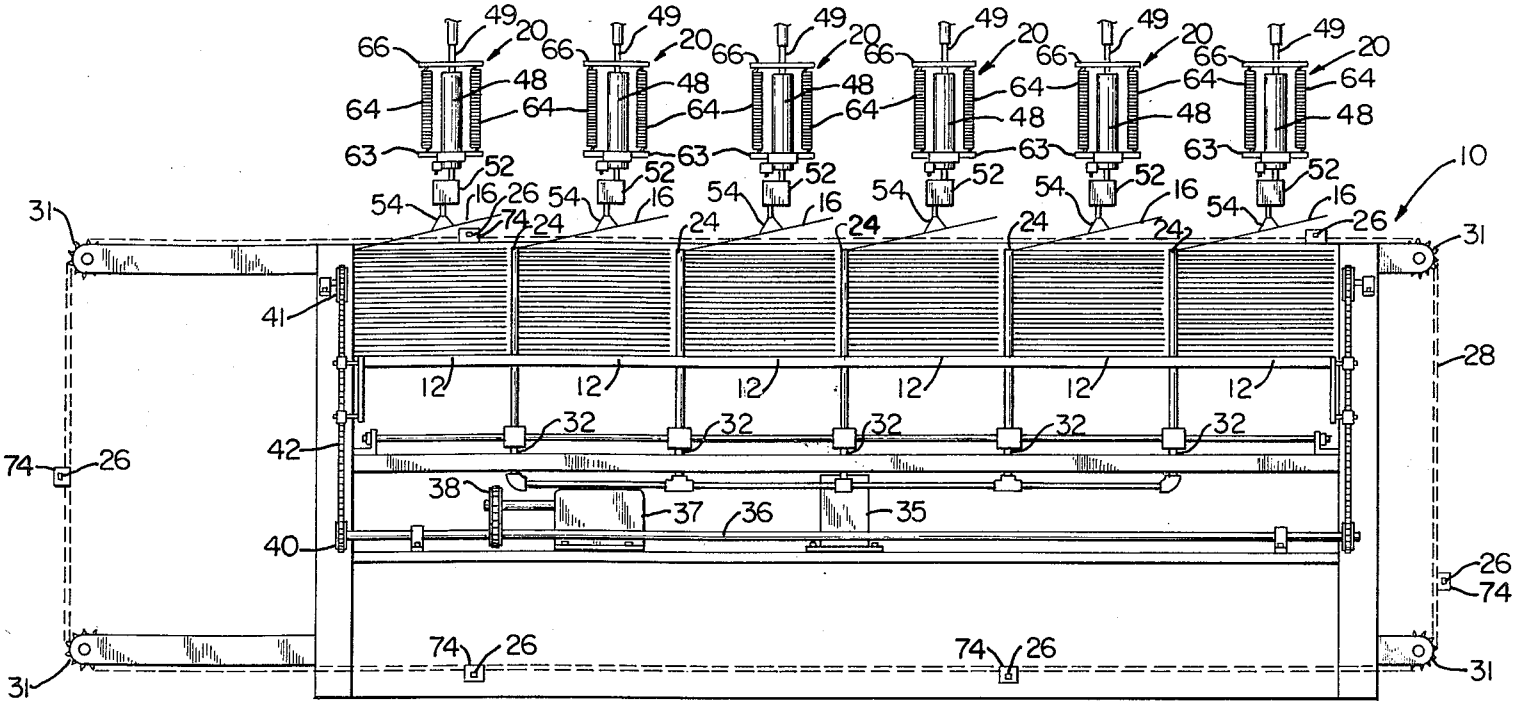
FIG. 2 is a cut away elevational view of the machine of FIG. 1.

Referring to FIGS. 1 and 2, a signature collating machine 10 is shown. For the purpose of illustration but not limitation, six supply stations 12 are shown in the machine 10, with four of these stations 12 in FIG. 1 having therein a stack of signatures 14 each comprising a top leaf 16 and a bottom leaf 18. In FIG. 2, all stations 12 house a stack of signatures 14. Upright rods 24 separate each station 12 from an adjacent station. Above each station 12 is a suction delivery assembly 20 to which leads a tube 22 in communication with a vacuum pump 56. A plurality of collector rods 26 are mounted in uniformly spaced relation to one another on a motor driven continuous sprocket chain 28 which travels transversely from right to left to sequentially gather signatures 14 at respective fold lines thereof for final delivery at the left of the machine as a collated folded stack 30. Said stack 30 is removed by an operator, and each respective rod 26 continues via the sprocket chain 28 for eventual re-appearance at the beginning of the collating cycle. Each station 12 is provided with an upright rigid tube 32 in communication with an air compressor 35 and having an orifice at the top end thereof through which air under pressure exits. Said air is directed toward the signature 14 at the top of the stack to separate the top leaf 16 from the bottom leaf 18 and cause said top signature 14 to float.

Figure 3:
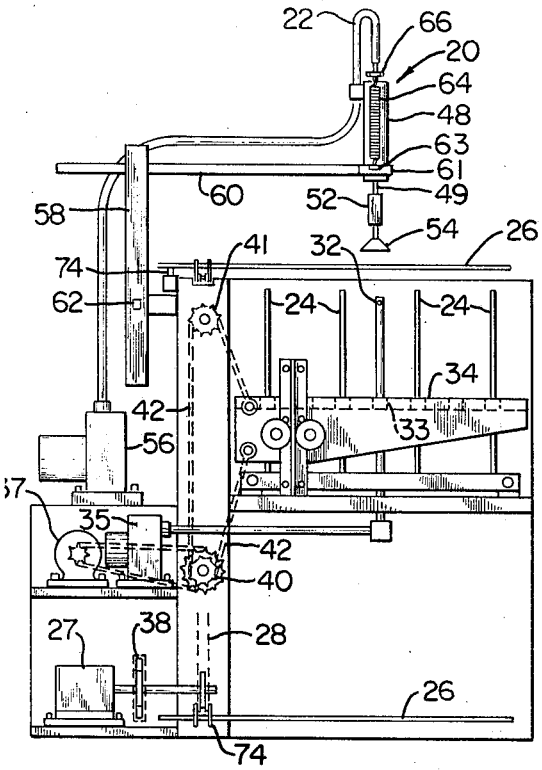
FIG. 3 is a cut away side elevational view of the machine of FIG. 1.
Figure 4:
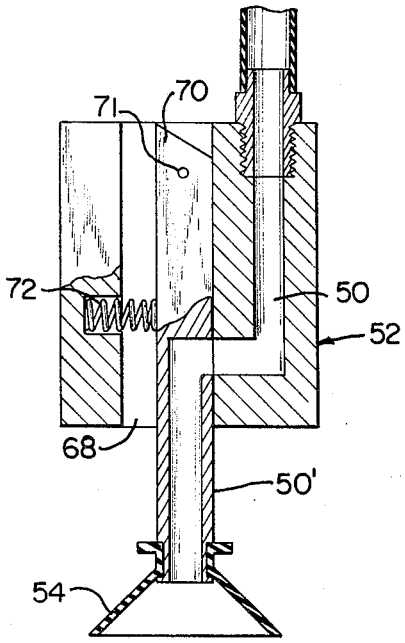
FIG. 4 is an enlarged side elevational view of a suction port and suction port housing of the machine of FIG. 1.
Figure 5:
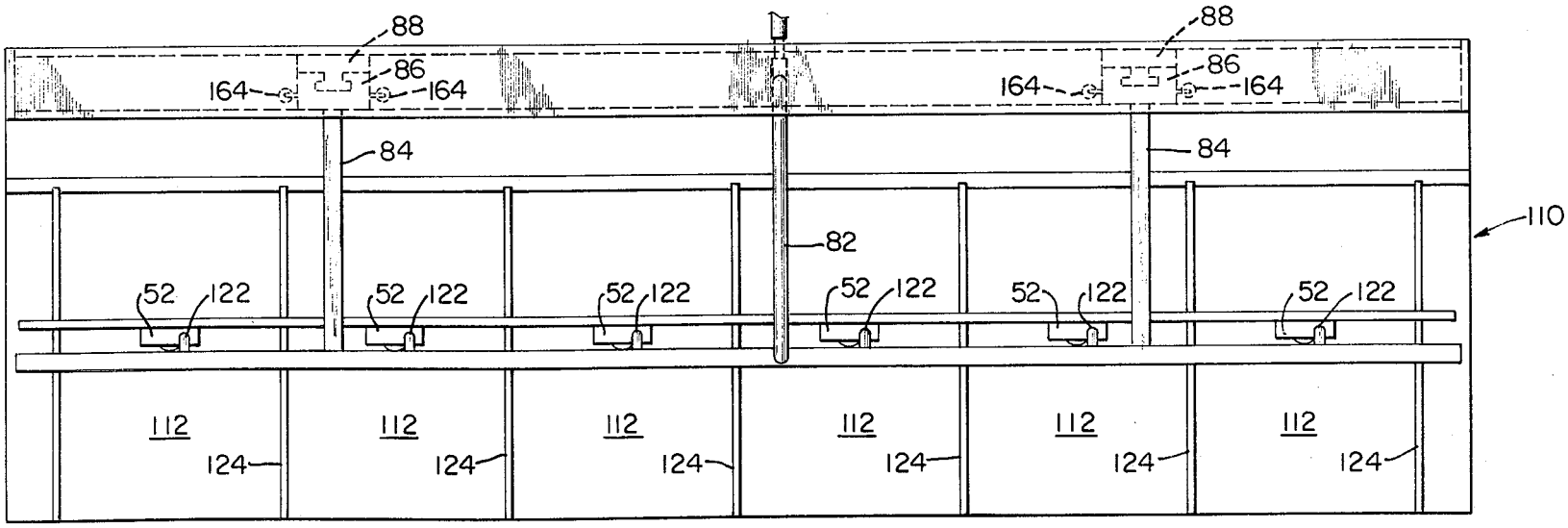
FIG. 5 is a top plan view of a modified form of signature collating machine.

The floor 34 of each supply station 12 is common to all supply stations 12, and is provided with drive means to cause said floor 34 to move upwardly until a stack of signatures 14 is at the correct height in each station 12 for operation of the collating machine 10. To this end, as shown in FIGS. 2 and 3, a shaft 36 is operable by a motor driven gear 38. At each end of the shaft 36 is a second gear 40. A third gear 41 is disposed above the second gear 40 and spaced therefrom. The sprockets of the second and third gears 40, 41 engage a chain 42 whose ends are secured to the side frame of the floor 34. Each station is provided with sensing means in the form of a microswitch 44 disposed on the back wall 46 of said stations. The microswitch 44 activates or deactivates operation of the motor driven gear 38. Specifically, a toggle portion or arm of said microswitch 44 protrudes unless depressed via pressure thereon from below. During operation of the machine 10, the motor 37 of the motor driven gear 38 is caused to operate when the microswitch 44 protrudes, thereby causing the floor 34 to rise via action upon the lower gear 40 and upper gear 41. When the top of a stack of signatures 14 housed in a supply station 12 reaches the microswitch 44 as the floor 34 rises, said stack exerts pressure from below on the microswitch 44 and depresses said microswitch. Upon such depression, circuitry from the microswitch 44 to the motor 37 operating the motor driven gear 38 causes the motor 37 to cease operation, thereby maintaining proper height level of the stack of signatures 14. As signatures 14 are removed during collating, the toggle portion of the microswitch 44 again protrudes, and the floor 34 again rises to maintain proper level. The upright rods 24 separating each station 12 from an adjacent station are each slidably mounted on a support bar 25 so that said rods 24 can be slidably positioned as required to permit a station 12 to accommodate varying width dimensions of stacks of signatures 14. Consequently, the floor 34 of the supply stations 12 has open channels 33 through which the uprights 24 protrude.

As earlier related, a plurality of spaced collector rods 26 are mounted for horizontal extension from a continuous motor driven sprocket chain 28, said continuity being shown in FIG. 2. As shown in FIG. 3, a motor 27 whose shaft has thereon a gear 29 engaged with the chain 28 determines movement of said chain 28 and resultant travel of the collector rods 26. Respective tensioning gears 31 disposed as shown in FIG. 2 maintain the chain 28 in a travel mode. Circuitry which causes activation and deactivation of the motor 27 and resultant travel of the collector rods 26 will be explained later.

A suction delivery assembly 20 is shown throughout the FIGS. 1-4, with one of each such assembly 20 mounted to be disposed above each supply station 12.

The delivery assembly 20 comprises, first of all, a vacuum cylinder 48 through which extends a tube 49 in communication at one end with a vacuum tube 22 and at the other end with a vacuum delivery tube 50 disposed within a suction port housing 52 and normally in communication with a suction port 54. A vacuum pump 56 establishes suction or a negative pressure in the vacuum tube 22 and into the housing 52 through the tube 49. From an upright standard 58 a horizontal bar 60 extends over a supply station 12. The vacuum cylinder 48 is mounted in a collar 61 of said bar 60. The upright standard 58 is slidably connected to a horizontal support 62 to enable proper placement of the assembly 20 over respectively varying dimensions of stacks of signatures 14.

A pair of springs 64 are disposed on opposite sides of the vacuum cylinder 48 extending between lateral brackets 33 on the collar 61 and a cross bar 66 disposed at the top of the vacuum cylinder 48. Said springs 64 are mounted under tension in parallel to the longitudinal axis of the cylinder 48 to move and maintain the suction delivery assembly in a downward configuration so that the suction port 54 is made to rest against the top signature 14 of a stack in each supply station 12. Beneath the vacuum cylinder 48 is disposed a generally rectangular suction port housing 52 which, an shown in sectional detail in FIG. 4, has a vertical channel 68 in which is disposed a pivotal rod 70 pivotal on shaft 71 and having a lower tubular portion 50' which defines a continuation of the tube 50. A spring 72 is mounted under compression within the channel 68 to rod 70 in a vertical position so that the tubes 50 and 50' are not interrupted at the junction of the two sections 68, 70. Extending downwardly from the pivotal rod 70 is the suction port 54 in communication with the suction delivery tubes 50 and 50'.

In operation, the several signature supply stations 12 of the machine 10 are loaded with signatures 14 for subsequent collating. Power is provided to the machine and the floor 34 of the supply stations 12 rises as necessary to provide proper placement of the stacks of signatures 14 as eariler recited. If the vacuum pump 56 has not been actuated, the suction port 54 will not engage a signature 14, but will merely rest above the top signature 14 of a stack, being held in a downward position by the springs 64 on each side of the vacuum cylinder 48. Pressurized air is delivered to the upright rigid tube 32 to fluff the top signature of each stack so that its leaves 16, 18 separate. Upon activation of the vacuum pump 56, suction is delivered to the suction port 54, and the top leaf 16 of the top signature 14 is drawn and held by the suction port 54. The degree of suction is such that its force overcomes the force of the springs 64, and the vacuum cylinder 48 rises to the full extension of the springs 64. Further, the suction port 52 rises in response to the applied suction to meet the base of said cylinder 48, resulting in a signature being held in the position shown in FIGS. 1 and 2.

Figure 2A:
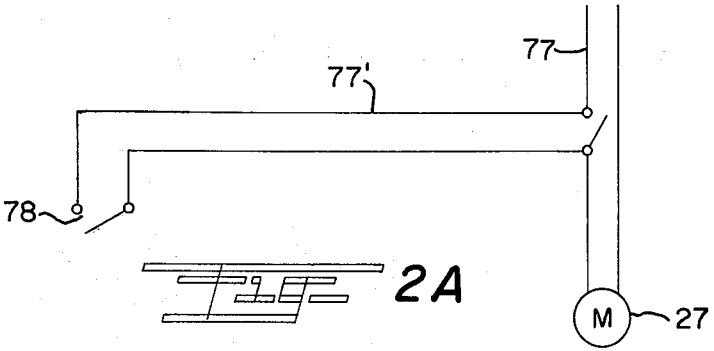
FIG. 2A is a somewhat schematic illustration of the electrical control circuit for the preferred form of present invention.

In order to coordinate the movement of the collector rods 26 and the suction delivery assembly 20, each collector rod 26 is provided with a transversely extending plate or arm 74 disposed at one end of the rod adjacent to the sprocket chain 28. A microswitch 76 is positioned ahead of each supply station in the path of travel of the arm 74, there being one microswitch 76 illustrated in FIG. 1 in advance of the second supply station. As a collector rod 26 is advanced by the drive chain 28, its connected arm 74 will move into contact with one of the microswitches 76 to open one portion of a circuit through line 77 leading to drive motor 27, as shown in FIG. 3A. A second series of microswitches 78 are disposed at the respective bases of the vacuum cylinders 48 so that when each suction port housing 52 rises into engagement with the base of the vacuum cylinder 48 as hereinbefore described, the housing 52 contacts the microswitch 78 and closes the circuit through line 77' to the motor 27. Thus, as schematically illustrated in FIG. 2A, assuming that the housing 52 has closed the microswitch 78 to close the circuit to the motor through line 77' ahead of the arrival of the collector rod 26, opening of the circuit by the microswitch 76 for the supply station will not interrupt motor operation and the collector rod will continue to advance into engagement with the signature held by the suction port housing. However, if the microswitch 78 is not engaged by the housing 52, when the arm 74 of the collector rod 26 advances into engagement with the microswitch 76 it will open the line 77 to the motor 27 whereby to interrupt the circuit and discontinue operation of the motor. In other words, unless a signature 14 is being held for collection by the rod, the rod will not pass the corresponsing supply station.

When a signature 14 is held in position as illustrated in FIGS. 1 and 2, each collector rod 26 will advance laterally within the fold of the signature and exert lateral pressure thereon which is transmitted to the suction port housing 52 so as to cause the pivot rod 70 to be deflected or pivoted about the shaft 71. Pivotal movement of the rod 70 will break communication between the delivery bores or tubes 50 and 50' so that suction is no longer applied to the suction port 54 and the signature will be released by the suction port to permit it to move with the collector rod and other signatures already collected by the rod 70. As soon as the suspended signature 14 is removed from the suction port 54, the return spring 72 within the suction port housing 52 will cause the pivot rod 70 to return to its original vertical disposition. Suction is re-established to the suction port 54 causing the housing to move away from the base of the cylinder 48 and to be drawn downwardly with the cylinder under the urging of the spring 64. The suction port will then move into engagement with another signature 14 at the top of the supply station and draw it upwardly as described for collection by the next collector rod 26. Each suction delivery assembly 20 is situated above a supply station 12 and operates automatically in a like manner to accomplish the collating operation.

DESCRIPTION OF ALTERNATE FORM OF THE PRESENT INVENTION

Figure 6:
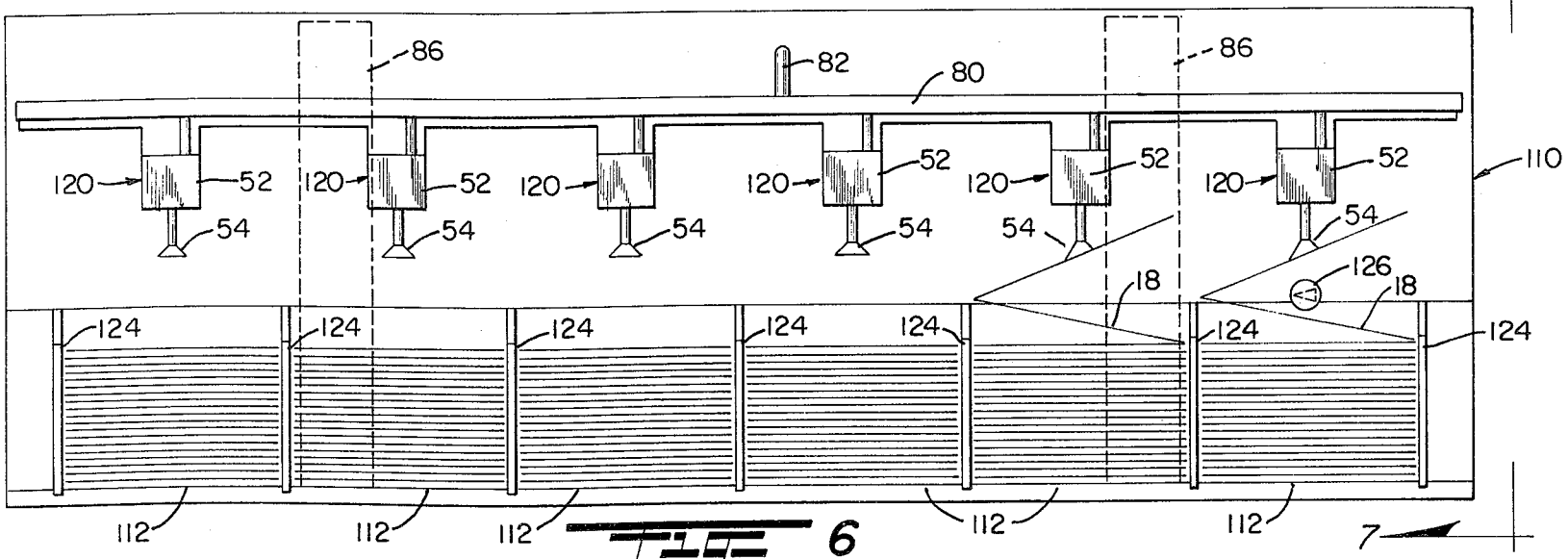
FIG. 6 is a front elevational view of the machine of FIG. 5.
Figure 7:
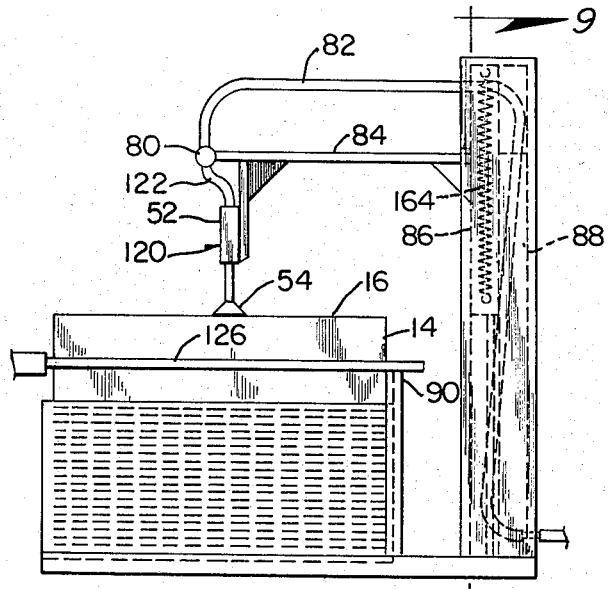
FIG. 7 is a side elevational view of taken along lines 7—7 of FIG. 6.
Figure 8:
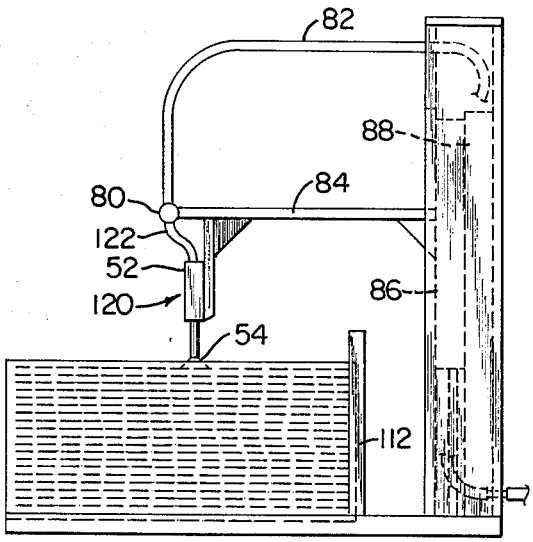
FIG. 8 is a side elevational view as shown in FIG. 7, with a suction port in a nonelevated position.

There is illustrated in FIGS. 5 to 10 a manually-operated signature collating machine 100. Again, for the purpose of illustration and not limitation, a series of six supply stations 112 are arranged in juxtaposed relation to one another, each station housing a stack of signatures 14 comprising a top leaf 16 and a bottom leaf 18. The stations are divided by upright partitions 124 which are slidable in a lateral direction to accommodate different widths of signatures 14. Above each station 112 is a suction delivery assembly 120 to which leads a tube 122, as shown in FIGS. 7 and 8, each tube being in communication with a rigid tubular member 80 which in turn communicates via a flexible tube 82 with a vacuum pump, not shown. A hand-held collector rod 126 is illustrated in FIGS. 6 and 7 in a position immediately prior to collection of the first signature.

Figure 9:
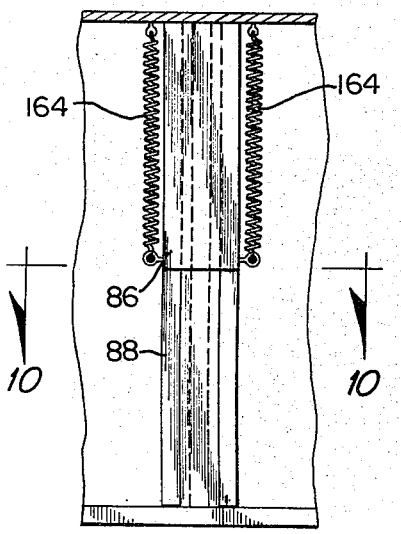
FIG. 9 is a section view taken at lines 9—9 of FIG. 7.
Figure 10:
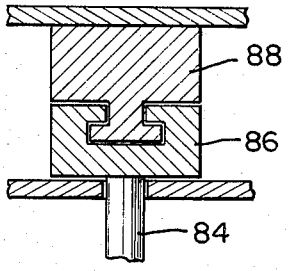
FIG. 10 is a section view taken along lines 10—10 of FIG. 9.

Each suction delivery assembly 120 comprises a suction port housing 52 corresponding to that previously described with reference to the preferred form of FIGS. 1 to 4, and accordingly, like elements are correspondingly enumerated. Thus, the suction delivery tube 50 communicates at one end with a tube 122 and at its other end with a suction port 54. The rigid tube 80 is mounted adjacent each end to a respective support rod 84, each support rod 84 extending from a respective vertically slidable, track-mounted support 86. Each of the supports 86 is mounted on a track 88 disposed on the back wall of the machine, and springs 164 extend from the top of the back wall to the bottom of the track-mounted support 86 so as to normally urge the support 86 to an elevated or raised position. FIG. 7 illustrates the relative disposition between the elements in the raised position with a guide track 90 for advancement of the collector rod 126 into engagement with the signatures 14. In turn, FIGS. 9 and 10 illustrate in more detail the relative disposition and arrangement between the track-mounted support 86 and the track 88 for each respective support rod 84.

In operation, each station 112 is loaded with a stack of signatures 14. Power is then supplied to the machine 110, resulting in suction being delivered to suction ports 54. The suction delivery assemblies 120 are in an elevated position under the urging of the lift springs 164. The suction delivery assemblies 120 are advanced downwardly by manually lowering the track-mounted support 86 on the track 88. Such movement places the suction ports 54 in communication with the top leaf 16 of the top signature 14, as shown in FIG. 8, resulting in the application of suction to the top leaf 16. The operator then removes downward pressure on the support 88 and the suction delivery assemblies 120 rise under the urging of the springs 164 on the track-mounted support 88. Such upward movement results in a signature 14 being held as shown in FIG. 7. The operator then grasps a collector rod 126 and moves it from right to left along the track 90 to sequentially gather the several signatures engaged by the several suction ports 54. The pivotal action of the suction port housings 52 results in cessation of vacuum to the suction ports 54 as the collector rod 126 exerts lateral pressure along the fold of each such signature in the same manner as earlier described in relation to the automatic machine of FIGS. 1–4. After the operator has collected all of the signatures so engaged with the suction ports 54, the tasks recited above are repeated to gather additional collated publications.

It is therefore to be understood that various modifications and changes may be made in the specific construction and arrangement of elements comprising the preferred and alternate forms of invention herein described without departing from the spirit and scope of the invention as defined by the appended claims.

We claim:

1. In a collating apparatus for sequentially engaging a plurality of individual folded signatures and gathering said signatures sequentially within each next signature in succession along the respective fold lines of said signatures for subsequent binding, the improvement comprising:

a plurality of juxtaposed signature stations for supporting said signatures;

vacuum producing means;

a suction delivery assembly including a suction port housing situated above each said signature station, each housing having a pivotal suction port in communication with said vacuum producing means, each said suction port engageable with the top leaf of a top signature disposed within its signature station, said suction delivery assembly including means urging each said suction port housing downwardly into engagement with said signatures at each signature station, said assembly having actuator means to overcome the downward urging of said means and to cause upward movement of each said housing only upon application of a vacuum through each said suction port when said suction port is in engagement with a signature; and at least one collector rod means movable between the leaves of the successive signatures as said signatures are engaged and lifted by the application of vacuum through respective said suction ports, said rod means as it collects each signature thereon operative to cause pivotal movement of said suction port to a position interrupting the application of vacuum through said suction port whereby to release said signature from said suction port as the vacuum is interrupted thereto.

2. In a collating apparatus according to claim 1 wherein said juxtaposed signature stations have laterally slidable dividers therebetween.

3. In a collating apparatus according to claim 1, the floor of said signature stations being vertically height adjustable via sensor means in response to the height of a stack of signatures thereon.

4. In a collating apparatus according to claim 1, each of said signature stations further having means for separation of the leaves of the top signature of a stack housed therein.

5. In a collating apparatus according to claim 1, said apparatus having means for directing a stream of air under pressure to separate leaves of the top signature of a stack of signatures in each signature station.

6. In a collating apparatus according to claim 1, including travel deactivation means in the path of said rod actuated by absence of a signature engaged with a suction port.

7. In a collating apparatus according to claim 1, including drive means to cause sequential advancement of a plurality of said rods between the leaves of successive signatures as said signatures are engaged and lifted by the application of vacuum through said suction ports.

8. In a collating apparatus according to claims 1 or 4, each suction port housing having a stationary portion with said pivotal suction port pivotally mounted thereon, and a vacuum delivery channel in communication with said vacuum producing means and extending through said stationary portion and pivotal suction port, said pivotal suction port being pivotal away from said stationary portion to interrupt the application of vacuum through said channel in response to engagement of a signature by said collector rod.

9. In a collating apparatus capable of engaging for subsequent collection a plurality of individual singularly folded signatures arranged in supply stations for housing signatures, the improvement comprising:

vacuum applying means; and a suction delivery assembly having a suction port housing, a portion of which is arcuately pivotal, and having protruding from said pivotal portion a suction port, said suction port housing having extending therethrough a vacuum delivery channel in communication with said vacuum applying means and extending first through a stationary portion of said housing and through said arcuately pivotal portion thereof, said suction port housing being in the form of a generally rectangular block provided with a vertically directed opening therein, said pivotal portion being pivotally mounted within said opening for downward projection of said suction port from said block, said channel extending through a portion of said block and said pivotal portion, means for yieldably urging said pivotal portion to a position forming a continuous channel through said block and pivotal portion of said suction port and said suction port including a lower extremity having a suction cup of rubber or rubber-like material thereon, the application of vacuum through said channel being interrupted when said pivotal portion of said housing is arcuately pivoted.

10. In a collating apparatus for sequentially engaging a plurality of individual folded signatures and gathering said signatures sequentially within each next signature in succession along the respective fold lines of said signatures for subsequent binding, the improvement comprising:

a plurality of juxtaposed signature stations for supporting said signatures;

vacuum producing means;

a suction delivery assembly including a suction port housing situtated above each said signature station, each suction port housing having a stationary portion and a pivotal suction port in communication with said vacuum producing means pivotally mounted on said stationary portion, said pivotal suction port normally assuming a first position wherein a vacuum delivery channel is in communication with said vacuum producing means and extends uninterruptedly through said stationary portion and pivotal suction port said pivotal suction port being pivotable from said first position to a second position which disconnects the delivery channel in said pivotal suction port from the channel in said stationary portion and signature pickup means movable between the leaves of the successive signatures as said signatures are engaged and lifted by the application of vacuum through respective said suction ports, said pickup means as it collects thereon each signature causing said pivotal suction port to pivot from said first to said second position to interrupt the application of vacuum to said channel whereby to release said signature from said suction port when the vacuum is interrupted thereto.

11. In a collating apparatus according to claim 10, each of said signature stations further having means for separation of the leaves of the top signature of a stack housed therein.

12. In a collating apparatus according to claim 10, said apparatus having means for directing a stream of air under pressure to separate leaves of the top signature of a stack of signatures in each signature station.

* * * * *

UNITED STATES PATENT AND TRADEMARK OFFICE

CERTIFICATE OF CORRECTION

PATENT NO. : 4,403,770

DATED : September 13, 1983

INVENTOR(S) : Leonard Ferguson and Jack W. Mefford

It is certified that error appears in the above—identified patent and that said Letters Patent is hereby corrected as shown below:

In the Specification:

Column 1, line 46, cancel "of" and substitute -- or --.

Column 5, line 26, cancel "an" and substitute -- as --.

Column 5, line 42, cancel "eariler" and substitute -- earlier --.

Column 6, line 24, cancel "sponsing" and substitute -- sponding --.

IN THE CLAIMS:

Claim 10, Column 10, line 11, after "portion" insert -- ; --.

Signed and Sealed this

Fifth Day of February 1985

[SEAL]

Attest:

DONALD J. QUIGG

Attesting Officer

Acting Commissioner of Patents and Trademarks